US006957705B2

(12) United States Patent
O'Brien et al.

(10) Patent No.: US 6,957,705 B2
(45) Date of Patent: Oct. 25, 2005

(54) LOADER LINKAGE

(75) Inventors: David Michael O'Brien, Dubuque, IA (US); Gregory Keith Werner, Durango, IA (US); Michael Dean Worley, Sandy, UT (US); George Madsen Robertson, Spanish Fork, UT (US); Dusan John Hvolka, Salt Lake, UT (US)

(73) Assignee: Deere & Company, Moline, IL (US)

( * ) Notice: Subject to any disclaimer, the term of this patent is extended or adjusted under 35 U.S.C. 154(b) by 82 days.

(21) Appl. No.: 10/648,107

(22) Filed: Aug. 26, 2003

(65) Prior Publication Data

US 2005/0045351 A1 Mar. 3, 2005

(51) Int. Cl.[7] ..... E02F 3/34

(52) U.S. Cl. ..... 172/831; 414/686; 414/697; 414/723; 37/234; 37/236

(58) Field of Search ..... 414/680, 685, 414/686, 694, 695.5–695.7, 697, 722, 699–715, 723; 37/231, 348, 234–236; 172/810, 811, 815–831

(56) References Cited

U.S. PATENT DOCUMENTS

| | | | | |
|---|---|---|---|---|
| 5,188,502 A | | 2/1993 | Tonsor et al. | 414/700 |
| 5,192,179 A | * | 3/1993 | Kovacs | 414/710 |
| 5,599,158 A | | 2/1997 | Ajilore | 414/685 |
| 5,993,138 A | | 11/1999 | Anderson et al. | 414/706 |

OTHER PUBLICATIONS

John Deere "Loaders", Model Nos. 304H, 324H and 344H, 18 pages, Mar. 2000.
John Deere "Tool Carriers", Model Nos TC44H, TC54H and TC62H, 12 pages, Aug. 2000.

* cited by examiner

*Primary Examiner*—Christopher J. Novosad

(57) ABSTRACT

A Z-bar loader linkage having a floating bell crank. A boom is pivotally mounted to a loader frame at one end and an attachment at the other end. The bell crank is pivotally mounted on leveling links extending forwardly from the loader frame. The drive end of the bell crank is provided with an attachment link that extends from the bell crank to the attachment for controlling the angular position of the attachment. A guide link extends between the attachment link and the boom.

23 Claims, 4 Drawing Sheets

LOADER LINKAGE

FIELD OF THE INVENTION

The present invention is directed to a Z-bar loader linkage having a bell crank that is pivotally coupled to the loader frame by a leveling link independent of the boom.

BACKGROUND OF THE INVENTION

Loaders are work vehicles having a loader linkage comprising a pivotal boom for vertically positioning an attachment coupled to the boom. The loader linkage is typically provided with an attachment tilt linkage for manipulating the angular position of the attachment relative to the boom.

One type of loader linkage is a Z-bar linkage. In a Z-bar linkage one end of the boom is pivotally mounted to a loader frame and the other end of the boom is pivotally attached to the attachment. The attachment may comprise a tool coupler to which a work tool is releasably mounted, or the attachment may comprise the tool itself. The Z-bar linkage comprises a bell crank having a bell crank pivot that is coupled to the boom. A hydraulic cylinder extending from the loader frame to the driven end of the bell crank pivot, pivots the bell crank relative to the boom moving the drive end of the bell crank. The drive end of the bell crank is coupled to the attachment for changing its angular position relative to the boom.

SUMMARY OF THE INVENTION

It is an object of the present invention to provide a loader linkage having good breakout force and parallel lift characteristics.

It is a feature of the present invention that the loader linkage is a Z-bar linkage having a floating bell crank.

The loader linkage of the present invention comprises a loader frame to which is mounted a boom. The loader end of the boom is pivotally mounted to the loader frame by a boom pivot and is pivoted relative to the loader frame by a boom lift hydraulic cylinder. The other end of the boom, the attachment end, is pivotally coupled to an attachment by an attachment pivot. The loader linkage is also provided with an attachment tilt linkage for controlling the angular position of the attachment relative to the boom. The attachment tilt linkage comprises a floating bell crank having a bell crank pivot that is coupled to the loader frame by a leveling link independent of the boom. The driven end of the bell crank is coupled to an attachment tilt hydraulic cylinder extending from the driven end of the bell crank to the loader frame. The drive end of the bell crank is provided with an attachment link that extends to the attachment. A guide link extends between the attachment link and the boom.

DETAILED DESCRIPTION

Figure 1:
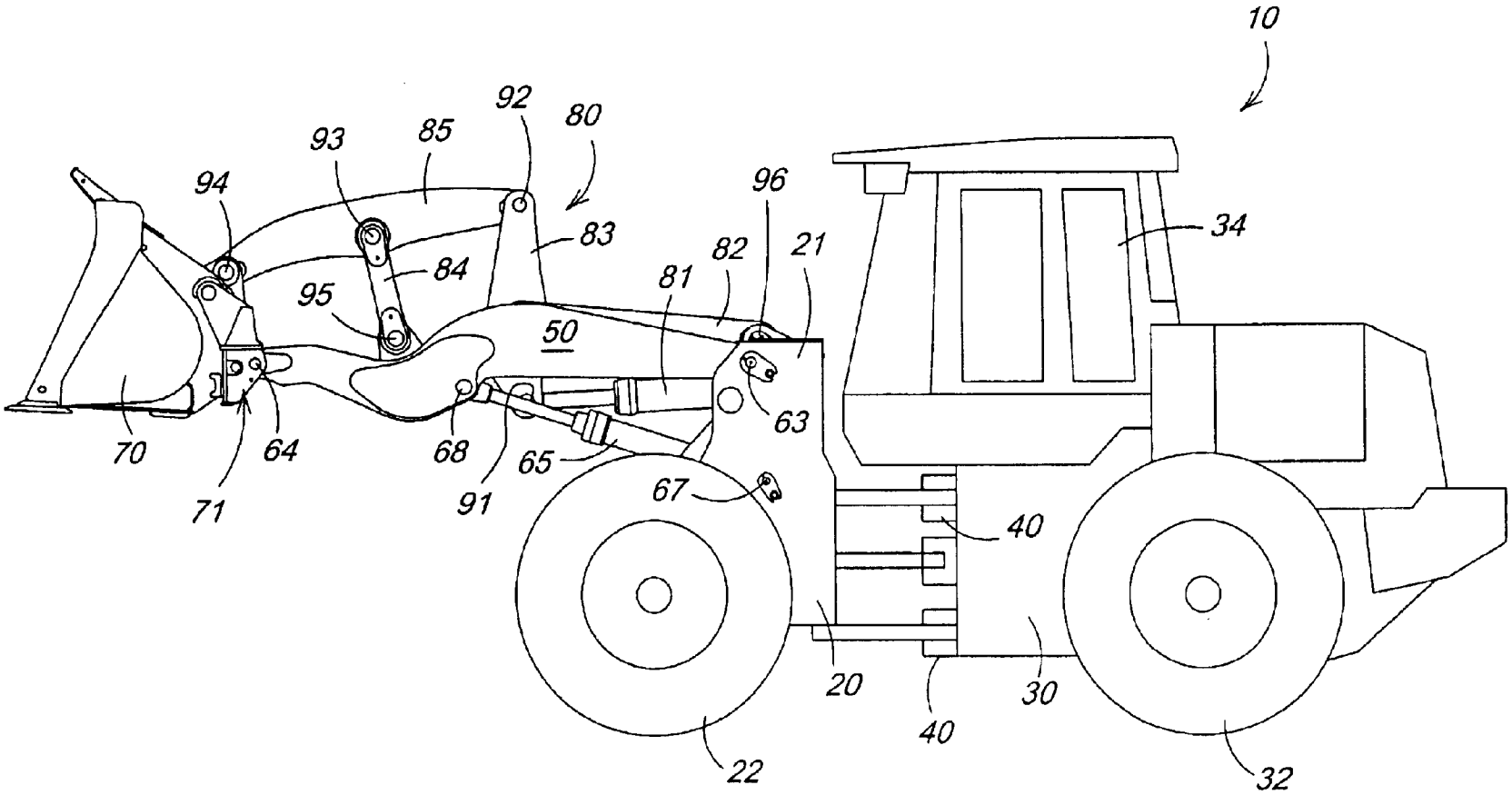
FIG. 1 is a side view of a four wheel drive loader.

FIG. 1 illustrates a work vehicle comprising a four wheel drive loader 10. The four wheel drive loader 10 is provided with an articulated frame having a loader frame 20 that is pivotally coupled to a rear frame 30 by vertical pivots 40.

The loader 10 is steered by pivoting the loader frame 20 relative to the rear frame 30 in a manner well known in the art. The front and rear frames 20 and 30 are respectively supported on front drive wheels 22 and rear drive wheels 32. An operator's station 34 is provided on the rear frame 30 and is generally located above the vertical pivots 40. The loader frame 20 includes a mast 21 formed by a right mast portion 21*a* and a left mast portion 21*b*. The front and rear drive wheels 22 and 32 propel the vehicle along the ground and are powered by an internal combustion engine, not shown, through a suitable transmission. The internal combustion engine is located on the rear frame 30. Although the present invention is disclosed as being used on a wheeled work vehicle it can also be used on belted or tracked work vehicles.

The loader frame is provided with a loader linkage comprising a boom 50 that is partly formed by right and left arms 50*a* and 50*b*, respectively. The middle portions of the right and left arms 50*a* and 50*b* are connected by a transverse cross tube 52 that is welded to each of the right and left arms 50*a* and 50*b*. The loader end of the boom 50 is connected to the mast 21 by transverse boom pivots 61 and 63. An attachment in the form of a loader bucket 70 is mounted on a tool coupler 71 which in turn is mounted to the attachment end of the boom 50 by transverse attachment pivots 64, only one shown. The boom 50 is rotated about transverse pivots 64 by boom lift hydraulic cylinders 65*a* and 65*b*, the rear ends of which are, respectively, connected to the loader frame 20 at transverse pivots 67, only one shown. The front ends of hydraulic lift cylinders 65*a* and 65*b* are, respectively, connected to the right and left arms 50*a* and 50*b* at transverse boom lift pivots 66 and 68. Although the illustrated loader 10 is shown as having a bucket 70 mounted to the tool coupler 71, other attachments can be mounted to the tool coupler or directly to the attachment end of the boom 50.

Figure 2:
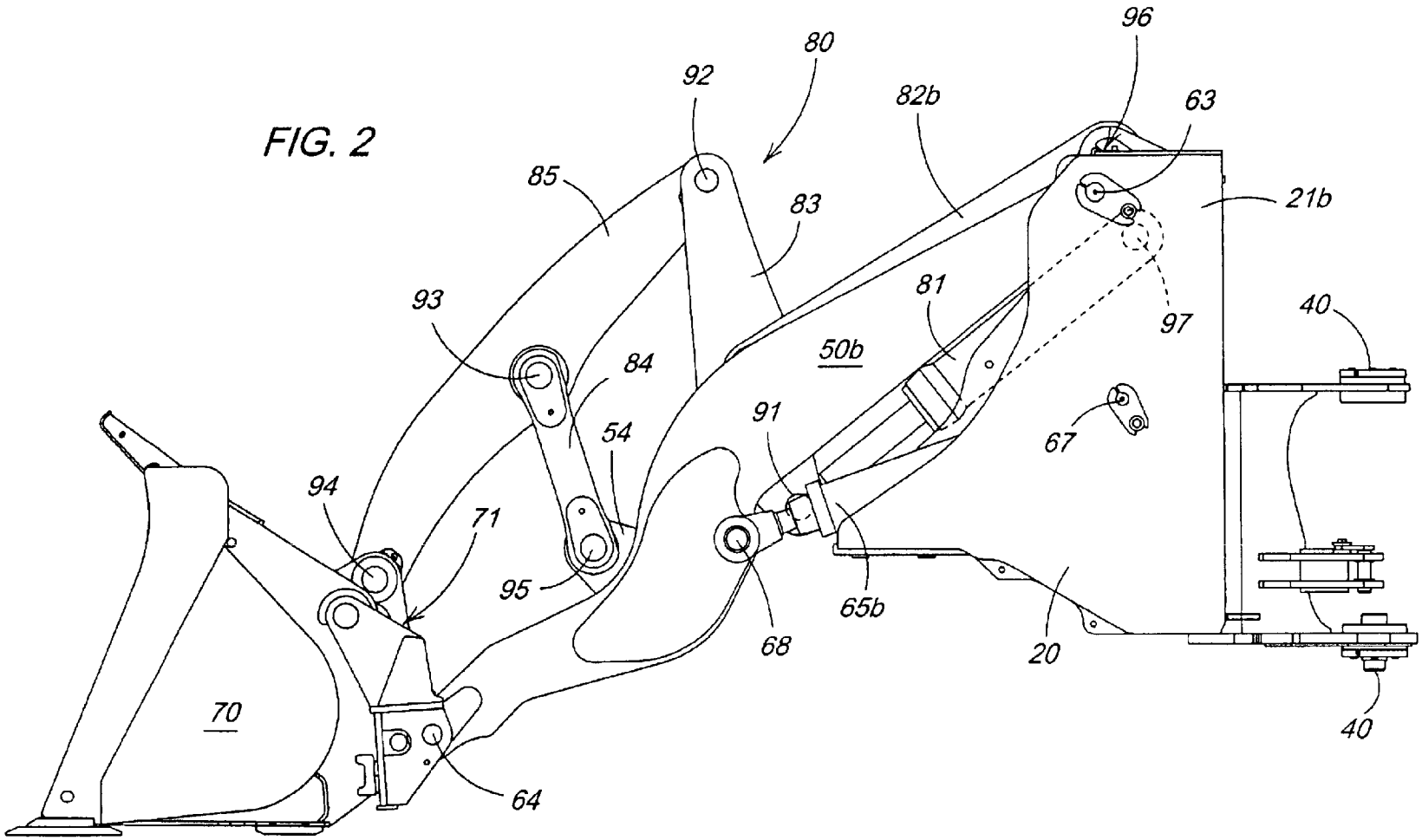
FIG. 2 is a side view of the loader linkage.
Figure 3:
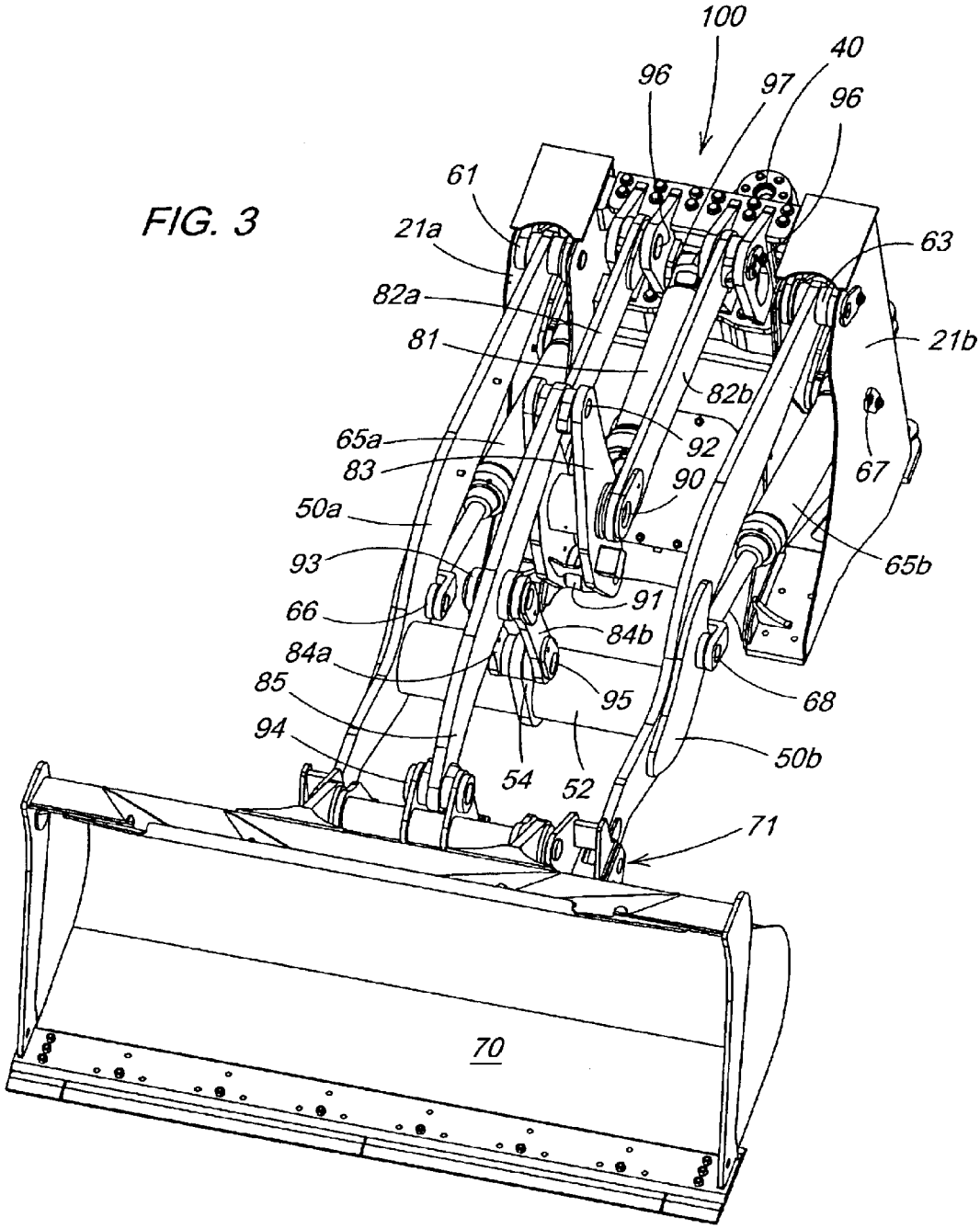
FIG. 3 is a top perspective view of the loader linkage.

The angular position of the bucket 70 relative to the boom 50 is controlled by an attachment tilt linkage 80. The attachment tilt linkage 80 comprises: a hydraulic tilt cylinder 81, leveling link 82; a bell crank 83, a guide link 84; and an attachment link 85. The hydraulic tilt cylinder 81 drives the tilt linkage 80 and extends between the loader frame 20 and the driven end of the bell crank 83 being pivotally coupled to a transverse driven pivot 91. The bell crank 83 is mounted on a transverse bell crank pivot 90 at the front end of the leveling link 82. In the embodiment illustrated in FIGS. 1–3, the leveling link 82 comprises right and left links 82*a* and 82*b*. As such, the bell crank 83 is independent of and floats relative to the boom 50. The drive end of the bell crank 83 is connected to the rear end of the attachment link 85 by a transverse drive pivot 92. The front end of the attachment link 85 is pivotally connected to the tool coupler 71 of the loader bucket 70 via a transverse pivot 94. A guide link 84 having right and left portions 84*a* and 84*b* extends between the middle portion of the boom 50 and the middle portion of the attachment link 85. The guide link 84 is mounted on a transverse guide pivot 93 on the attachment link 85 and on the cross tube 52 via a transverse guide tube pivot 95 carried in a support 54 welded to the cross tube 52.

The entire rear end of the attachment tilt linkage, including the rear end of the hydraulic tilt cylinder 81 and the loader end of the leveling link 82 are operatively mounted to a removable linkage pin support 100. The removable linkage pin support 100 is rigidly connected to the loader frame 20 at load bearing areas via bolts.

The leveling link 82 is pivotally coupled to the removable linkage pin support 100 and in turn the mast 21 by leveling link pivots 96. The leveling link pivots 96 are located above and behind the boom pivots 63. The tilt cylinder 81 is pivotally coupled to the removable linkage pin support 100 and in turn the mast 21 by tilt cylinder loader pivots 97. The tilt cylinder loader pivots 97 are located below and behind the boom pivots 63.

Figure 4:
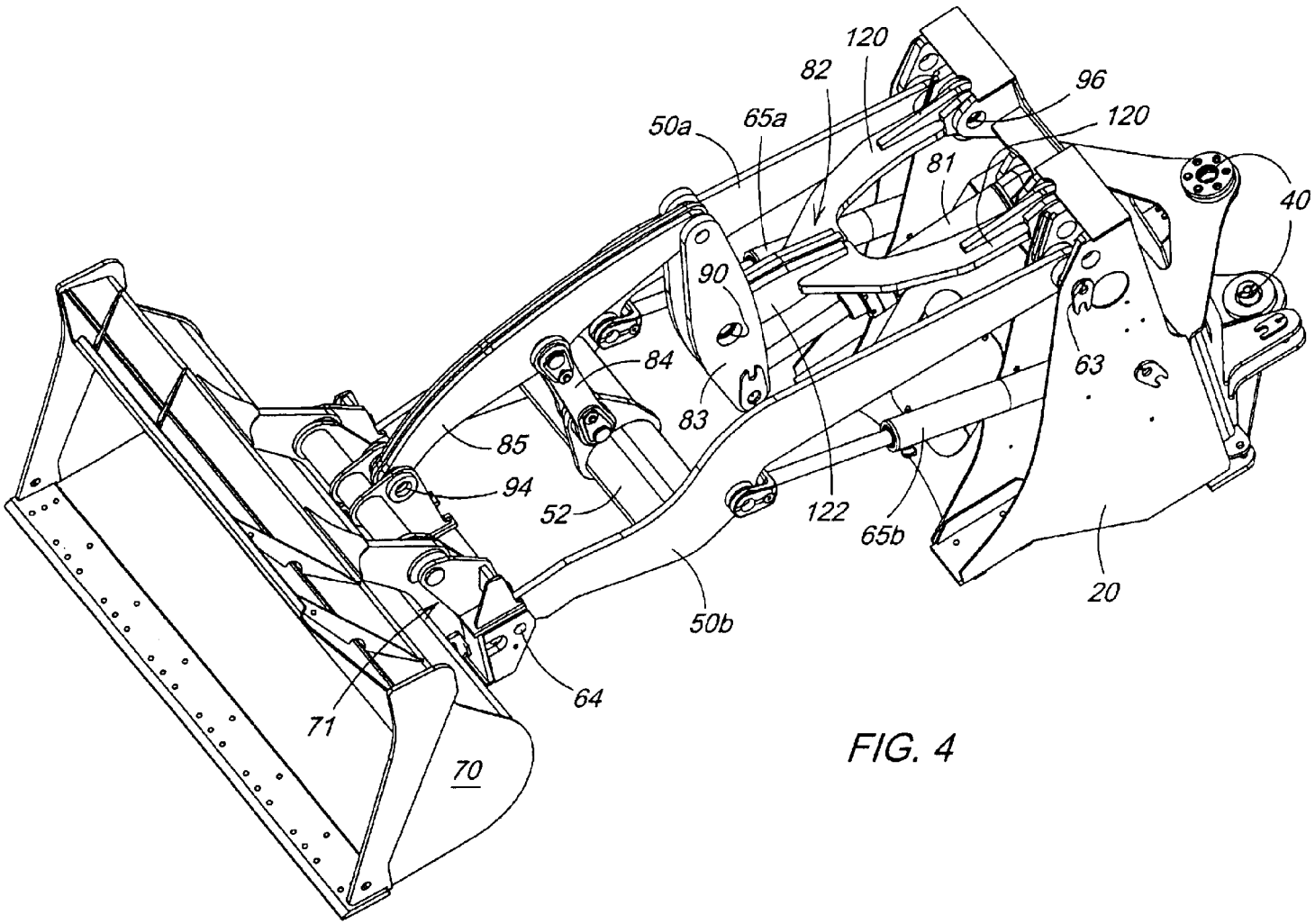
FIG. 4 is a top perspective view of an alternative embodiment of the loader linkage.

In an alternative embodiment illustrated in FIG. 4 the leveling link 82 comprises a single Y-link. The Y-link has two legs 120 that are pivotally coupled to the mast 21 by leveling link pivots 96. The base 122 of the Y-link is pivotally coupled to the bell crank by the transverse bell crank pivot 90.

Having described the illustrated embodiments, it will become apparent that various modifications can be made without departing from the scope of the invention as defined in the accompanying claims.

What is claimed is:

1. A loader linkage comprising:

a loader frame;

a boom having a loader end and an attachment end, a middle portion being located between the loader and attachment ends, the loader end of the boom being pivotally coupled to the loader frame by a boom pivot;

an attachment is pivotally coupled to the attachment end of the boom and having an angular position relative to the boom;

an attachment tilt linkage controls the angular position of the attachment relative to the boom, the attachment tilt linkage comprises a leveling link having a first end that is pivotally coupled to the loader frame by a leveling link pivot and a second end, a bell crank having a drive end and a driven end, the bell crank is pivotally coupled to the second end of the leveling link by a bell crank pivot located between the drive end and the driven end, a linear actuator extends between the loader frame and the driven end of the bell crank for pivoting the bell crank about the bell crank pivot, an attachment link is pivotally coupled to the drive end of the bell crank and extends to the attachment for controlling the angular position of the attachment relative to the boom.

2. The loader linkage as defined by claim 1 further comprising a guide link that extends between the middle portion of the boom and the attachment link.

3. The loader linkage as defined by claim 2 wherein the boom comprises right and left arms that are coupled to one another by a transverse cross tube, the transverse guide tube being provided with a support to which the guide link is pivotally attached to the boom.

4. The loader linkage as defined by claim 3 wherein the leveling link pivot is located above and behind the boom-loader pivot.

5. The loader linkage as defined by claim 4 wherein the tilt cylinder loader pivot is located below and behind the boom pivot.

6. The loader linkage as defined by claim 3 wherein the tilt cylinder loader pivot is located below and behind the boom pivot.

7. The loader linkage as defined by claim 1 wherein the leveling link pivot is located above and behind the boom loader pivot.

8. The loader linkage as defined by claim 7 wherein the tilt cylinder loader pivot is located below and behind the boom pivot.

9. The loader linkage as defined by claim 1 wherein the tilt cylinder loader pivot is located below and behind the boom pivot.

10. A work vehicle for performing a work operation, the work vehicle comprising:

a frame:

ground engaging means for supporting and propelling the frame;

a mast extending upwardly from the frame;

a boom having a loader end and an attachment end, a middle portion being located between the loader and attachment ends, the loader end of the boom being pivotally coupled to the loader frame by a boom pivot;

an attachment is pivotally coupled to the attachment end of the boom and having an angular position relative to the boom;

an attachment tilt linkage controls the angular position of the attachment relative to the boom, the attachment tilt linkage comprises a leveling link having a first end that is pivotally coupled to the mast by a leveling link pivot and a second end, a bell crank having a drive end and a driven end, the bell crank is pivotally coupled to the second end of the leveling link by a bell crank pivot located between the drive end and the driven end, a linear actuator extends between the mast and the driven end of the bell crank for pivoting the bell crank about the bell crank pivot, an attachment link is pivotally coupled to the drive end of the bell crank and extends to the attachment for controlling the angular position of the attachment relative to the boom.

11. The work vehicle as defined by claim 10 further comprising a guide link that extends between the middle portion of the boom and the attachment link.

12. The work vehicle as defined by claim 11 wherein the boom comprises right and left arms that are coupled to one another by a transverse cross tube, the transverse guide tube being provided with a support to which the guide link is pivotally attached to the boom.

13. The work vehicle as defined by claim 12 wherein the leveling link pivot is located above and behind the boom loader pivot.

14. The work vehicle as defined by claim 13 wherein the tilt cylinder loader pivot is located below and behind the boom pivot.

15. The work vehicle as defined by claim 14 wherein the tilt cylinder loader pivot is located below and behind the boom pivot.

16. A loader linkage comprising:

a loader frame;

a boom having a loader end and an attachment end, a middle portion being located between the loader and attachment ends, the loader end of the boom being pivotally coupled to the loader frame by a boom pivot;

an attachment is pivotally coupled to the attachment end of the boom and having an angular position relative to the boom;

an attachment tilt linkage controls the angular position of the attachment relative to the boom, the attachment tilt linkage comprises a floating bell crank and a leveling link, the floating bell crank pivotally coupled to the loader frame via the leveling link independent of the boom, the floating bell crank having drive end and a driven end, a linear actuator extends between the loader frame and the driven end of the floating bell crank for pivoting the floating bell crank, an attachment link is pivotally coupled to the drive end of the floating bell crank and extends to the attachment for controlling the angular position of the attachment relative to the boom.

17. The loader linkage as defined by claim 16 further comprising a guide link that extends between the middle portion of the boom and the attachment link.

18. The loader linkage as defined by claim 17 wherein the leveling link comprises a single Y-link.

19. A work vehicle for performing a work operation, the work vehicle comprising:

a frame:

ground engaging means for supporting and propelling the frame;

a mast extending upwardly from the frame;

a boom having a loader end and an attachment end, a middle portion being located between the loader and attachment ends, the loader end of the boom being pivotally coupled to the loader frame by a boom pivot;

an attachment is pivotally coupled to the attachment end of the boom and having an angular position relative to the boom;

an attachment tilt linkage controls the angular position of the attachment relative to the boom, the attachment tilt linkage comprises a floating bell crank and a leveling link, the floating bell crank pivotally coupled to the loader frame via the leveling link independent of the boom, the floating bell crank having a drive end and a driven end, a linear actuator extends between the loader frame and the driven end of the floating bell crank for pivoting the floating bell crank, an attachment link is pivotally coupled to the drive end of the floating bell crank and extends to the attachment for controlling the angular position of the attachment relative to the boom.

20. The work vehicle as defined by claim 19 further comprising a guide link that extends between the middle portion of the boom and the attachment link.

21. The work vehicle as defined by claim 20 wherein the leveling link comprises a single Y-link.

22. A loader linkage comprising:

a loader frame;

a boom having a loader end and an attachment end, a middle portion being located between the loader and attachment ends, the loader end of the boom being pivotally coupled to the loader frame by a boom pivot;

an attachment is pivotally coupled to the attachment end of the boom and having an angular position relative to the boom;

an attachment tilt linkage controls the angular position of the attachment relative to the boom, the attachment tilt linkage comprises a floating bell crank and a leveling link, the floating bell crank pivotally coupled to the loader frame via the leveling link independent of the boom, the floating bell crank having drive end and a driven end, a linear actuator extends between the loader frame and the driven end of the floating bell crank for pivoting the floating bell crank, an attachment link is pivotally coupled to the drive end of the floating bell crank and extends to the attachment for controlling the angular position of the attachment relative to the boom; and a guide link that extends between the middle portion of the boom and the attachment link.

23. A work vehicle for performing a work operation, the work vehicle comprising:

a frame:

ground engaging means for supporting and propelling the frame;

a mast extending upwardly from the frame;

a boom having a loader end and an attachment end, a middle portion being located between the loader and attachment ends, the loader end of the boom being pivotally coupled to the loader frame by a boom pivot;

an attachment is pivotally coupled to the attachment end of the boom and having an angular position relative to the boom;

an attachment tilt linkage controls the angular position of the attachment relative to the boom, the attachment tilt linkage comprises a floating bell crank and a leveling link, the floating bell crank pivotally coupled to the loader frame via the leveling link independent of the boom, the floating bell crank having a drive end and a driven end, a linear actuator extends between the loader frame and the driven end of the floating bell crank for pivoting the floating bell crank, an attachment link is pivotally coupled to the drive end of the floating bell crank and extends to the attachment for controlling the angular position of the attachment relative to the boom; and a guide link that extends between the middle portion of the boom and the attachment link.

* * * * *